US005697431A

United States Patent [19]

Nagasaka

[11] Patent Number: 5,697,431

[45] Date of Patent: Dec. 16, 1997

[54] HEAT EXCHANGER TUBE CLIP

[75] Inventor: Yoshikiyo Nagasaka, Saitama, Japan

[73] Assignee: Zexel USA Corporation, Decatur, Ill.

[21] Appl. No.: 688,534

[22] Filed: Jul. 30, 1996

[51] Int. Cl.[6] ..... F28D 7/02

[52] U.S. Cl. ..... 165/149; 165/153; 165/178; 165/67; 248/229.2; 248/74.3; 248/74.1

[58] Field of Search ..... 165/178, 149, 165/153, 67; 248/74.1, 74.3, 229.2

[56] References Cited

U.S. PATENT DOCUMENTS

| | | | |
|---|---|---|---|
| 1,373,716 | 4/1921 | Dottl et al. | 248/74.1 X |
| 1,468,110 | 9/1923 | Howe | 248/229.2 X |
| 1,787,734 | 1/1931 | Rowling | 248/74.3 X |
| 5,205,349 | 4/1993 | Nagao et al. | 165/153 X |
| 5,209,290 | 5/1993 | Chigira | 165/178 X |
| 5,261,633 | 11/1993 | Mastro | 248/74.1 |
| 5,429,182 | 7/1995 | Hanafusa | 165/149 X |
| 5,441,100 | 8/1995 | Ueda et al. | 165/149 X |

*Primary Examiner*—John Rivell
*Assistant Examiner*—Christopher Atkinson
*Attorney, Agent, or Firm*—James E. Bradley

[57] ABSTRACT

A clip for securing a manifold tube to an automotive heat exchanger has a portion which secures to a support plate of the heat exchanger without brazing. The base of the clip has a lip which inserts over an edge of the plate. A loop joins the base and extends around the tube. A leg joins the other end of the loop and has a lip which is inserted over an opposite edge of the plate. A fastener secures the first and second ends of the loop to each other to grip the tube and hold the lips in gripping engagement with the edges of the plate.

19 Claims, 1 Drawing Sheet

HEAT EXCHANGER TUBE CLIP

BACKGROUND OF THE INVENTION

1. Field of the Invention

This invention relates in general to brackets for supporting tubes, and in particular to a clip for securing a manifold tube to an automotive heat exchanger.

2. Description of the Prior Art

One type of automotive heat exchanger is an air conditioner condenser. One type of vehicle air conditioner condenser is a parallel flow type, which has two header tubes spaced apart and parallel to each other. Thin flat flow tubes extend between the header tubes, the flow tubes being parallel to each other. Fins are spaced between the flow tubes. A manifold inlet tube or pipe extends to one of the headers for supplying refrigerant. An outlet tube extends to the other header to provide an outlet for the flow of refrigerant.

Condensers of this nature are typically manufacturered by assembling the headers, flow tubes and fins and clamping them into a fixture. The entire fixture and assembly then passes through a furnace which brazes the components together. Often the inlet and outlet tubes are also clamped into the fixture and brazed to the condenser during the brazing process. A clip or bracket may be secured to the inlet tube to hold the inlet tube to the condenser. Generally, the clip will have a loop portion which receives the tube and will have another portion which is brazed to one portion of the condenser, such as the header. The outlet tube is smaller in diameter and may not require a clip.

In some cases, the inlet tube cannot be brazed in the furnace. This occurs, for example, when the inlet tube extends over a portion of the fins. The brazing fixture interferes with the position of the inlet tube. In these cases, the inlet tube must be hand-brazed to the condenser after the condenser has passed through the brazing furnace. Usually, a bracket or clip which holds the inlet tube is also hand-brazed to a portion of the condenser, such as a header. While there are a number of successful techniques employed, hand-brazing the clip to a header requires additional manufacturing expense.

SUMMARY OF THE INVENTION

A clip is provided for connecting a tube to a heat exchanger without brazing the clip to the heat exchanger. The clip grips the tube and secures it to a flat support plate which is a part of the condenser. The clip is a single piece member having a base which overlies the support plate. The base has a lip which inserts over one edge of the support plate. A loop joins the base and encircles the tube. A leg joins the other end of the loop. The leg has a lip which inserts over an opposite edge of the support plate. A fastener joins the first and second ends of the loop to grip the tube and simultaneously secure the lips in gripping engagement with the plate.

DETAILED DESCRIPTION OF THE PREFERRED EMBODIMENT

Figure 1:
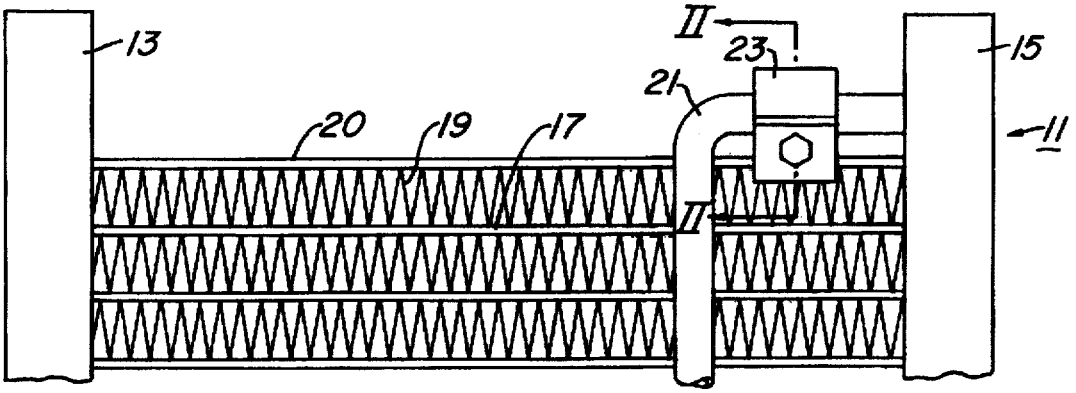
FIG. 1 is a partial elevational view illustrating a condenser having a clip constructed in accordance with this invention.

Referring to FIG. 1, the heat exchanger shown is an automotive air conditioning condenser 11 of a parallel flow type. Condenser 11 has two spaced apart tubular headers 13, 15, which may be cylindrical or oval. A number of thin flat flow tubes 17 extend between the headers 13, 15 parallel to each other. Flow tubes 17 have passages for flowing refrigerant between headers 13, 15. Serpentine fins 19 are located between each of the flow tubes 17. A flat metal support plate 20 is located on each end of condenser 11. Support plates 20, also commonly called "side plates", extend between headers 13, 15 for providing rigidity.

An aluminum manifold or inlet tube 21 is shown joined to the upper end of header 15 to supply refrigerant to header 15. There will also be a similar but smaller diameter outlet tube (not shown) extending into the lower end of header 13. Inlet tube 21 is cylindrical and secured in place by a bracket or clip 23. Tube 21 and clip 23 are installed after condenser 11 has passed through a brazing furnace.

Figure 2:
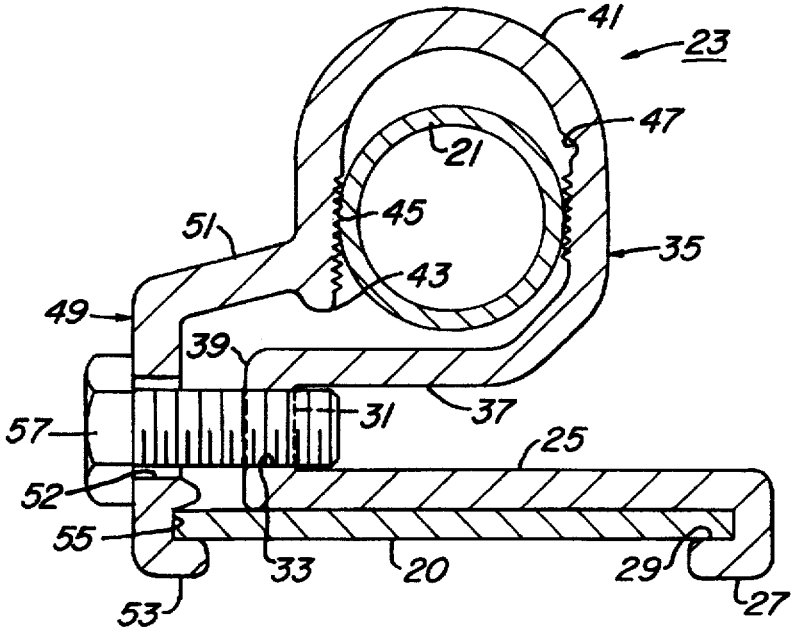
FIG. 2 is an enlarged sectional view of the clip of FIG. 1, taken along the line II—II of FIG. 1.

Referring to FIG. 2, clip 23 is a single-piece aluminum member having a flat base 25 which overlies support plate 20. Base 25 extends about three-fourths of the width of plate 20. Base 25 has a second or distal end with a lip 27 formed on it. Lip 27 is spaced from and parallel to base 25, defining a groove 29. Groove 29 fits over one edge of support plate 20, having a width substantially the same as the thickness of support plate 20. A joinder section 31 extends outward from base 25 at a first or proximal end of base 25. Joinder section 31 is a flat, short section perpendicular to base 25. Joinder section 31 has a circular hole 33 formed within it.

Figure 3:
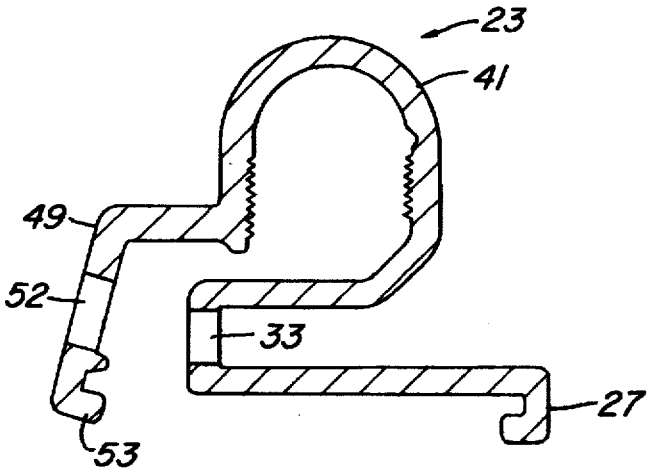
FIG. 3 is a smaller side view showing the clip of FIG. 1 in a pre-installed position.

A loop 35 is joined to base 25 by joinder section 31. Loop 35 has a first loop portion 37 which has a first end 39 that is integrally joined to joinder section 31. First loop portion 37 is substantially flat and parallel to base 25 when clip 23 is installed as shown in FIG. 2. First loop portion 37 extends back over base 25 a significant distance and is spaced from base 25 by the length of joinder section 31. First loop portion 37 joins a U-shaped portion 41. U-shaped portion 41 has a second end 43 that almost touches first end 39, so that loop 35 will extend around inlet tube 21 approximately 360 degrees. The opening to the U-shaped portion 41 is on the side next to base 25, while the curved portion of U-shaped portion 41 is on the opposite side. U-shaped portion 41 has teeth 45 formed on opposite inner sides for gripping tube 21. A stress relief groove 47 is formed in loop 35 in its U-shaped portion 41 to facilitate flexing from the pre-installed position shown in FIG. 3 to the installed position shown in FIG. 2.

A leg 49 joins the second end 43 of loop 35. Leg 49 has an offset portion 51 which joins and extends outward from second end 43. When clip 23 is installed, offset portion 51 will lie at an angle of approximately 15 degrees relative to base 25. The remaining portion of leg 49, once installed, will be perpendicular to base 25. A hole 52 extends through leg 49 in alignment with hole 33 once in the installed position. A lip 53 is formed on a distal end of leg 49. Lip 53 is configured the same as lip 27, defining a groove 55 for receiving an opposite edge of support plate 20. A threaded fastener or screw 57 of conventional nature extends through holes 33, 52, self-tapping into hole 33.

During manufacturing, first the components of condenser 11 will be clamped into a fixture and passed through a brazing furnace. Then inlet tube 21 will be hand-brazed to a hole provided in header 15. Clip 23 will then be installed. In the pre-installed position shown in FIG. 3, leg 49 will be inclined at an acute angle relative to base 25. Hole 52 will be misaligned with hole 33. An opening is presented between leg 49 and joinder section 31 to receive tube 21. The teeth 45 will be spaced farther apart as well. Leg 49 will need to be pulled further outward to force clip 23 over tube 21. Once forced over tube 21, the installer slides lip 27 over one edge of support plate 20. He presses leg 49 toward support plate 20 and slides lip 53 over the opposite edge of support plate 20.

He then inserts fastener 57 and tightens it. As he tightens fastener 57, lips 53 and 27 will move toward each other and tightly grip the edges of support plate 20. Simultaneously, the sides of the loop U-shaped portion 41 will move towards each other. Teeth 45 will bite slightly into tube 21 to grip tube 21. The deformation from the pre-installed position of FIG. 3 to the installed position of FIG. 2 exceeds the elastic limits of the material of clip 23 and thus is a permanent deformation.

The invention has significant advantages. The clip is readily installed by a fastener. It needs no hand-brazing to secure it to the condenser. It is of a single piece and inexpensive.

While the invention has been shown in only one of its forms, it should be apparent to those skilled in the art that it is not so limited, but is supsectible to various changes without departing from the scope of the invention.

I claim:

1. A clip for securing a tube to a support plate, comprising:

a base having a lip adapted to insert over an edge of the plate;

a loop adapted to receive the tube, the loop having a first end joined to the base and a second end;

a leg joined to the second end of the loop and having a lip which is adapted to insert over an opposite edge of the plate; and fastener means for securing the first and second ends of the loop to each other to grip the tube and for securing the lips in gripping engagement with the edges of the plate.

2. The clip according to claim 1 wherein:

the clip is deformable between a pre-installed position and an installed position; and while in the pre-installed position, the first and second ends of the loop are spaced apart from each other a pre-installed distance and the lips are spaced apart from each other a pre-installed distance, the pre-installed distances between the lips and between the first and second ends of the loop being greater than installed distances between the lips and between the first and second ends of the loop, respectively.

3. The clip according to claim 1 wherein the base has a flat portion adapted to overlie the plate between the edges.

4. The clip according to claim 1 wherein the fastener means while being installed draws the first and second ends of the loop toward each other to grip the tube and simultaneously draws the lips toward each other to grip the edges of the plate.

5. The clip according to claim 1 wherein each of the lips defines a groove for receiving one of the edges of the plate.

6. The clip according to claim 1, further comprising teeth located in an interior side of the loop for gripping the tube.

7. The clip according to claim 1 wherein the fastener means comprises a threaded fastener which secures to holes formed in the leg and the clip next to the first end of the loop.

8. A single-piece clip for securing a tube to a support plate, comprising:

a base having first and second ends separated by a flat portion which is adapted to overlie the plate, the second end having a lip which defines a groove adapted to insert over an edge of the plate;

a loop adapted to receive the tube, the loop having a first end and a second end;

a joinder section extending from the first end of the base and joining the first end of the base with the first end of the loop;

a leg joined to the second end of the loop and having a lip which defines a groove adapted to insert over an opposite edge of the plate;

mating holes formed in the leg and in the joinder section; and a threaded fastener which engages the holes and secures the first and second ends of the loop to each other to grip the tube and secures the lips in gripping engagement with the edges of the plate.

9. The clip according to claim 8 wherein:

the clip is deformable between a pre-installed position and an installed position; and while in the pre-installed position, the first and second ends of the loop are spaced apart from each other a pre-installed distance and the lips are spaced apart from each other a pre-installed distance, the pre-installed distances between the lips and between the first and second ends of the loop being greater than installed distances between the lips and between the first and second ends of the loop, respectively.

10. The clip according to claim 8 wherein the fastener, while being secured within the holes, draws the first and second ends of the loop toward each other to grip the tube and simultaneously draws the lips toward each other to grip the edges of the plate.

11. The clip according to claim 8, further comprising teeth located in an interior side of the loop for gripping the tube.

12. The clip according to claim 8 wherein the loop has a first portion which joins the first end of the loop and which is substantially flat, parallel to the flat portion of the base and spaced from the base by a length of the joinder section.

13. The clip according to claim 8 wherein the joinder section is substantially perpendicular to the flat portion of the base.

14. In a refrigerant heat exchanger having a pair of headers joined together by flow tubes and at least one flat support plate, at least one manifold tube extending into one of the headers for refrigerant flow, an improved clip for securing the manifold tube to the heat exchanger, comprising:

a base having a lip which engages an edge of the plate;

a loop through which the manifold tube passes, the loop having a first portion terminating in a first end and a second portion terminating in a second end;

a joinder section joining the first end of the loop to the base;

a leg joined to the second end of the loop and having a lip which engages an opposite edge of the plate;

mating holes extending through the joinder section and the leg; and a threaded fastener which extends through the holes and secures the first and second ends of the loop to each other to grip the tube and secures the lips in gripping engagement with the edges of the plate.

15. The heat exchanger according to claim 14 wherein:

the base has a flat portion overlying the plate; and the first portion of the loop extends from the joinder section in a direction generally parallel to the flat portion of the base.

16. The heat exchanger according to claim 14 wherein the lips define grooves which receive the edges of the plate.

17. The heat exchanger according to claim 14 wherein:

the clip is deformable between a pre-installed position and an installed position; and while in the pre-installed position, the first and second ends of the loop are spaced apart from each other a pre-installed distance and the lips are spaced apart from each other a pre-installed distance, the pre-installed distances between the lips and between the first and second ends of the loop being greater than installed distances between the lips and between the first and second ends of the loop, respectively.

18. The heat exchanger according to claim 14 wherein the fastener, while being secured within the holes, draws the first and second ends of the loop toward each other to grip the tube and simultaneously draws the lips toward each other to grip the edges of the plate.

19. The heat exchanger according to claim 14, further comprising teeth located in an interior side of the loop for gripping the tube.

* * * * *